US008094088B2

(12) United States Patent
Shinkawa et al.

(10) Patent No.: US 8,094,088 B2
(45) Date of Patent: Jan. 10, 2012

(54) ANTENNA APPARATUS

(75) Inventors: Tomohiro Shinkawa, Tokyo (JP); Masaaki Miyata, Tokyo (JP); Hisamatsu Nakano, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 459 days.

(21) Appl. No.: 12/372,222

(22) Filed: Feb. 17, 2009

(65) Prior Publication Data

US 2009/0207086 A1 Aug. 20, 2009

(30) Foreign Application Priority Data

Feb. 18, 2008 (JP) ..... P2008-036551
Dec. 18, 2008 (JP) ..... P2008-321757

(51) Int. Cl.
*H01Q 1/36* (2006.01)

(52) U.S. Cl. ..... 343/895; 343/700 MS; 343/793

(58) Field of Classification Search ..... 343/700 MS, 343/895, 793, 821, 713
See application file for complete search history.

(56) References Cited

U.S. PATENT DOCUMENTS

2004/0169614 A1* 9/2004 Desclos et al. ..... 343/803
2009/0303143 A1* 12/2009 Miyoshi et al. ..... 343/728

FOREIGN PATENT DOCUMENTS

JP 2001-339232 12/2001
JP 2003-218632 7/2003
JP 2006-13696 1/2006
JP 2001-235460 9/2007

* cited by examiner

*Primary Examiner* — Tan Ho
(74) *Attorney, Agent, or Firm* — Whitham Curtis Christofferson & Cook, PC

(57) ABSTRACT

In an antenna apparatus, a radiation element includes a perturbation element. A first power feeding line has a first end connected to the radiation element and is configured to feed power to the radiation element. A second power feeding line has a first end configured to feed power to the radiation element through electromagnetic coupling. The radiation element, the first power feeding line and the second power feeding line are arranged on a same plane to constitute a balance type antenna.

13 Claims, 8 Drawing Sheets

ANTENNA APPARATUS

BACKGROUND

The present invention is related to an antenna apparatus. More specifically, the present invention is directed to an antenna apparatus which is used as a global positioning system (GPS) antenna, and the like.

As is well known in this technical field, the GPS (Global Positioning System) corresponds to a satellite positioning system with employment of artificial satellites. In the GPS system, electromagnetic waves (GPS signals) having frequencies of approximately 1.57 GHz are received from 4 sets, or more sets of artificial satellites among 24 sets of artificial satellites which are orbiting the earth; positional relationships and temporal errors between these artificial satellites and a moving object are measured based upon the received electromagnetic waves; and a position and an altitude of the moving object on a map can be calculated based upon the basic idea of the trigonometrical survey.

Very recently, the GPS systems are utilized in vehicle navigation systems capable of detecting positions of traveling automobiles, namely, are widely popularized. Vehicle navigation apparatuses are arranged by GPS-purpose antennas, processing apparatuses, display apparatuses, and the like. The GPS-purpose antennas are employed in order to receive GPS signals. The processing apparatuses process the GPS signals received by the GPS-purpose antennases so as to detect present positions of vehicles. The display apparatuses display the present position of the vehicles detected by the processing apparatuses on maps.

On the other hand, in connection with the progress of current compact communication appliances (for example, GPS type vehicle navigation apparatuses, portable type navigation apparatuses, satellite waves receivers, etc.) such as mobile communication appliances, compactnesses and high performance as to antenna apparatuses utilized in these communication appliances are required.

Among these antenna apparatuses, plane type antenna apparatuses (for instance, circular polarized patch antenna, etc.) have such merits that antenna structures thereof are made slim and compact, and these plane type antenna apparatuses can be comparatively easily manufactured in the form of integrated circuits in combination with semiconductor circuits. As a result, these plane type antenna apparatuses are widely employed as antennas utilized in compact communication apparatuses.

As such plane type antenna apparatuses, for instance, antenna apparatuses having the below-mentioned antenna structures are known (refer to, for example, patent document 1): That is, these antenna apparatuses are equipped with circular polarized antenna elements, and circuit boards in which LNA (Low Noise Amplifiers) are formed on rear planes thereof. The circular polarized antenna elements are formed by so-called "patch antenna element." The circular polarized antenna elements contain dielectric substrates which are manufactured by high dielectric materials such as ceramics. While radiation elements are formed on front surfaces of the dielectric substrates, ground patterns are formed on rear surfaces of the dielectric substrates. Pin holes penetrated from the front surfaces through the rear surfaces of the dielectric substrates are formed in the dielectric substrates. Power feeding pins penetrate through the pin holes, while the power feeding pins connect the radiation elements to the circuit boards. In the plane type antenna apparatuses equipped with the above-described antenna structures, since electric capacitances of antennas can be secured based upon the dielectric substrates made of the high dielectric materials, resonant frequencies of these antennas are lowered, so that the plane type antenna apparatuses can be made compact. In such patch antenna elements, since ground patterns are provided opposite to radiation elements, gains along directions of high elevation angles become high.

In any case, as GPS-purpose antennas, circular polarized antenna elements are used. In other words, GPS signals correspond to circular polarized waves. Further, circular polarized waves are also utilized in the field of ETC signals.

As is well known, an ETC (Electronic Toll Collection) system corresponds to such a system developed as the measure capable of relaxing traffic jams occurred in tool gates where tools as to toll roads (speedways, etc.) are paid. In other words, the above-described ETC system implies such a system that payments of tools are automatically accomplished by utilizing wireless communications at tool gates of speedways. In the above-explained ETC system, ETC signals are communicated in bidirectional communication manners between road-sided antennas equipped in gates installed at tool gates, and gate-passing vehicles equipped with on-vehicle communication appliances having ETC-purpose antennas so as to acquire vehicle information about these gate-passing vehicles, so that the ETC system can execute toll paying business for speedways without stopping the gate-passing vehicles.

There are some possibilities that ETC-purpose antennas are mounted on interior portions of vehicles. For instance, certain ETC-purpose antennas may be set on dashboards under certain angled conditions, or some ETC-purpose antennas may be set on glass of windshields. Also, mounting of ETC-purpose antennas in advance is popularized. That is to say, ETC-purpose antennas are mounted on interior portions of vehicles in factories of vehicle manufactures. In this factory mounting case, there are many cases that these ETC-purpose antennas are installed under such a condition that the ETC-purpose antennas are embedded in rear sides of room mirrors, and embedded under dashboards.

Also, circular polarized plane antennas (curl antenna elements) are known in which circular polarized waves are radiated by elements having spiral shapes.

Referring to FIG. 1 and FIG. 2, a description is made of a conventional cud antenna element.

The curl antenna element 60 is constructed by employing a spiral (whirling) radiation element (antenna element) 62, a ground plate 64 located opposite to the radiation element 61, and a power feeding portion 66 raised from the ground plate 64 along a vertical direction. The ground plate 64 and the spiral-shaped radiation element 62 are arranged substantially parallel to each other. A feeding point 66*a* of the power feeding portion 66 is provided at a near center of the ground plate 64. It should be noted that an insulator 64*a* such as a through hole is provided at a center portion of the ground plate 64. As a consequence, the feeding point 66*a* is not electrically connected to the ground plate 64. In any case, the conventional curl antenna element 60 is an antenna element having a three-dimensional structure.

It should also be noted that curl antenna elements are disclosed in, for instance, a patent document 2 and a patent document 3. While the curl antenna elements disclosed in these patent documents 2 and 3 have three-dimensional structures, since these antenna elements have ground planes which are located opposite to antenna elements in a parallel manner, impedances can be readily matched with each other. Also, the curl antenna elements disclosed in these patent documents 2 and 3 constitute such directional antennas having high gains along zenithal directions thereof due to the ground planes located opposite to the antenna elements.

The above-described patch antenna elements and curl antenna elements are manufactured in the three-dimensional structures, so that thicknesses of antenna elements thereof become bulky. As a result, these patch antenna elements and curl antenna elements can be hardly made thinner. That is to say, in such a case that ground planes located opposite to antenna elements cannot be installed, the patch antenna elements and the curl antenna elements cannot be used as circular polarized antenna elements.

To solve this problem, as the circular polarized antenna elements, film antennas are known which are adhered to windshields of vehicles (refer to, for example, patent document 4). The film antenna disclosed in the patent document 4 is equipped with a single loop-shaped film antenna capable of receiving circular polarized waves on a transparent film. This circular polarized antenna element corresponds to a right-hand polarized antenna equipped with a loop antenna and a non-power feeding element. While edge portions of the loop antenna in the power feeding side are formed in land shapes, these land shapes construct a first power feeding terminal and a second power feeding terminal. The first and second power feeding terminals are connected to first and second connection terminals of a connector which contains a low noise amplifier (LNA) circuit. The connector is connected to a coaxial cable. As a consequence, the first power feeding terminal is connected via the LNA circuit to an inner conductor of the coaxial cable, and the second power feeding terminal is connected to an outer conductor of the coaxial cable.

It should also be noted that as on-vehicle type antenna apparatuses, on-vehicle type digital terrestrial antenna apparatuses used so as to receive digital terrestrial broadcasting waves are known.

[Patent Document 1] Japanese Patent Publication No. 2001-339232 A

[Patent Document 2] Japanese Patent Publication No. 2007-235460 A

[Patent Document 3] Japanese Patent Publication No. 2003-218632 A

[Patent Document 4] Japanese Patent Publication No. 2006-013696 A

In the case that such an antenna apparatus which requires a ground plane located opposite to a radiation element (curl antenna element), as disclosed in the above-described patent documents 2 and 3, is manufactured with employment of a film antenna structure as disclosed in the patent document 4, in the film antenna, the ground plane located opposite to the radiation element cannot be formed, so that impedance matching of the radiation element with respect to the ground plane becomes very difficult.

SUMMARY

It is therefore one advantageous aspect of the present invention to provide an antenna apparatus capable of achieving better impedance matching with respect to a radiation element which requires a ground plane (for example, curl antenna element) as a film antenna, even in such a case that the ground plane located opposite to the radiation element cannot be sufficiently secured.

It is also one advantageous aspect of the present invention to provide a composite antenna apparatus which is operable as both a GPS-purpose antenna and a digital terrestrial broadcasting receiving-purpose antenna.

According to one aspect of the invention, there is provided an antenna apparatus comprising:

a radiation element including a perturbation element;

a first power feeding line, having a first end connected to the radiation element and configured to feed power to the radiation element; and a second power feeding line, having a first end configured to feed power to the radiation element through electromagnetic coupling, wherein the radiation element, the first power feeding line and the second power feeding line are arranged on a same plane to constitute a balance type antenna.

The antenna apparatus may be configured such that: the second power feeding line has a part extending parallel to the first power feeding line.

The antenna apparatus may further comprise: a transparent substrate on which the radiation element, the first power feeding line and the second feeding line are provided.

The antenna apparatus may be configured such that: the transparent substrate is a resin film.

The antenna apparatus may be configured such that: the transparent substrate is a glass plate.

The antenna apparatus may further comprise: a transparent substrate in which the radiation element, the first power feeding line and the second feeding line are embedded.

The antenna apparatus may be configured such that: the transparent substrate is a glass plate.

The antenna apparatus may be configured such that: the antenna apparatus is configured to serve as a GPS antenna receiving a GPS signal of a 1.57 GHz frequency band.

The antenna apparatus may be configured such that: the second power feeding line is disposed adjacent to the first power feeding line; the second power feeding line has a part extending parallel to the first power feeding line; the antenna apparatus is configured to serve as a balance type antenna when a second end of the first power feeding line and a second end of the second power feeding line are electrically disconnected; and the antenna apparatus is configured to serve as a monopole antenna when the second end of the first power feeding line and the second end of the second power feeding line are electrically connected.

The antenna apparatus may further comprise: a resonant circuit, electrically connecting the second end of the first power feeding line and the second end of the second power feeding line in a parallel manner, and configured to electrically connect or disconnect the second end of the first power feeding line and the second end of the second power feeding line in accordance with a frequency band received by the antenna apparatus.

The antenna apparatus may be configured such that: the balance type antenna is configured to serve as a GPS antenna receiving a GPS signal of a 1.57 GHz frequency band; and the monopole antenna is configured to serve as a digital terrestrial antenna receiving digital terrestrial broadcasting signal.

The antenna apparatus may be configured such that: the radiation element is curl-shaped.

The antenna apparatus may be configured such that: the electromagnetic coupling is established at a position adjacent to the first end of the first power feeding line.

DETAILED DESCRIPTION OF EXEMPLIFIED EMBODIMENTS

Figure 1:
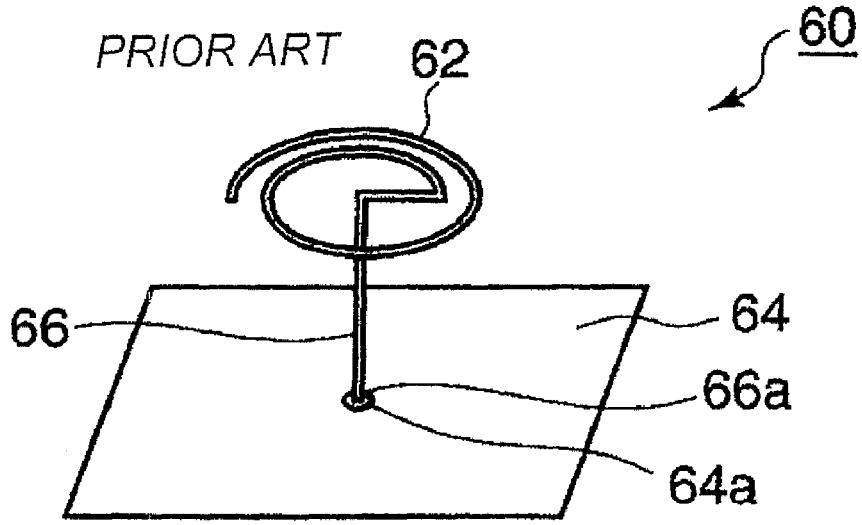
FIG. 1 PRIOR ART
FIG. 1 is a perspective view showing a conventional curl antenna element.
Figure 2:
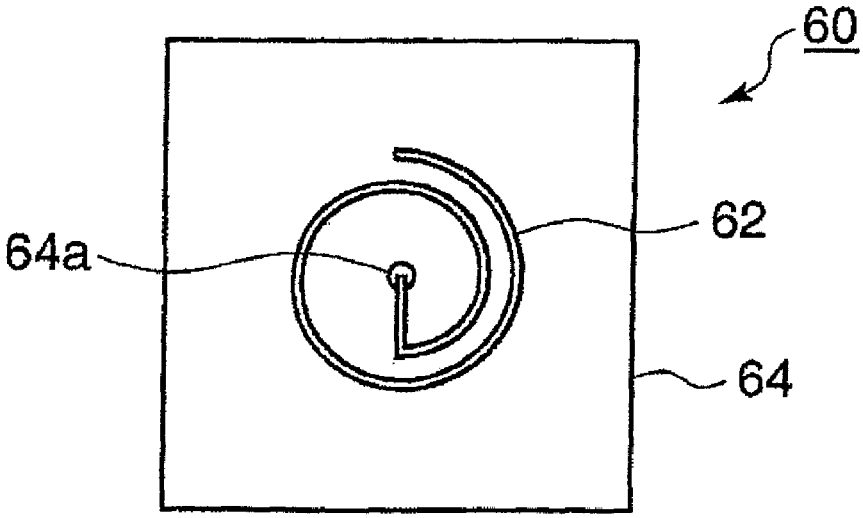
FIG. 2 PRIOR ART
FIG. 2 is a plan view showing the conventional curl antenna element.

Exemplified embodiments of the invention will be described below in detail with reference to the accompanying drawings Referring to FIG. 3, a description is made of an antenna apparatus 10 according to a first embodiment of the present invention. The antenna apparatus 10 shown in this drawing corresponds to a GPS-purpose antenna capable of receiving GPS signals transmitted from GPS satellites.

The antenna apparatus 10 shown in the drawings is constructed of a film antenna. In other words, the antenna apparatus 10 is constructed by employing a transparent resin film 11, and a GPS antenna pattern 20 formed on the resin film 11. The GPS antenna pattern 20 is formed on the same plane.

The GPS antenna pattern 20 is arranged by a curl-shaped radiation element (antenna element) 21 having a perturbation element 211, a first power feeding line 22, and a second power feeding line 23. The first power feeding line 22 is employed in order to directly feed electric power to the curl-shaped radiation element 21. While the second power feeding line 23 is elongated parallel to the first power feeding line 22 and is approximated thereto, the second power feeding line 23 is employed in order to feed electric power with respect to the radiation element 21 through electromagnetic coupling. The power feeding operation by the second power feeding line 23 by utilizing the electromagnetic coupling is performed in order to easily adjust impedance matching of the antenna apparatus 10.

The first power feeding line 22 and the second power feeding line 23, which are shown in the drawings, are elongated shorter than a dimension (diameter) of the radiation element 21.

The radiation element 21 shown in the drawing has a quadrangle (rhombic). In other words, the radiation element 21 has a first edge 21-1, a second edge 21-2, a third edge 21-3, and a fourth edge 21-4 along a clockwise direction in this order from a tip 22*a* of the first power feeding line 22. One edge of the above-described perturbation element 211 is connected to a tip 21-4*a* of the fourth edge 21-4. In other words, the perturbation element 211 is provided inside the first edge 21-1 of the radiation element 21. Both the first edge 21-1 and the fourth edge 21-4 are provided at positions which are approximated to both the first power feeding line 22 and the second power feeding line 23, whereas both the second edge 21-2 and the third edge 21-3 are provided at positions which are separated far from the first power feeding line 22 and the second power feeding line 23. As a consequence, both the first edge 21-1 and the fourth edge 21-4 are provided in a portion lower than a dashed line "A" of FIG. 3, whereas the second edge 21-2 and the third edge 21-3 are provided in a portion higher than the dashed line "A." In the above-described exemplification, such a case is described that the radiation element 21 is provided along the clockwise direction, and the right spiral circular polarized waves are received by the radiation element 21. In the case that left-hand circular polarized waves are received, the radiation element 21 is arranged in a counter-clockwise direction.

A first feeding point 26 is formed at a root portion of the first power feeding line 22, and a second feeding point 27 is formed at a root portion of the second power feeding line 23. A balun (balanced to unbalanced transformer) 29 is arranged between the first and second feeding points 26 and 27, and also, an intermediate terminal 29*a* so as to perform an unbalanced power feeding-to-balanced power feeding conversion between the intermediate terminal 29*a*, and the first and second feeding points 26 and 27, so that electric power is supplied to the first feeding point 26 and the second feeding point 27, respectively. The balun 29 is mounted on a circuit board provided in a connector 40 (refer to FIG. 5), which will be discussed later.

In the example shown in the drawing, while the electric power is directly fed from the first power feeding line 22 to the first edge 21-1 of the radiation element 21, the electric power is fed by utilizing the electromagnetic coupling from the second power feeding line 23 to the fourth edge 21-4 of the radiation element 21. The second power feeding line 23 has an electromagnetic coupling portion 231 which is electromagnetically coupled to the fourth edge 21-4 of the radiator element 21.

As previously described, the balance type GPS pattern 20 is constructed by employing the radiation element 21, the first power feeding line 22, and the second power feeding line 23. Since the GPS antenna pattern 20 is manufactured in the form of the balance type GPS antenna, such a ground plane located opposite to the radiation element 21 is no longer required.

Figure 3:
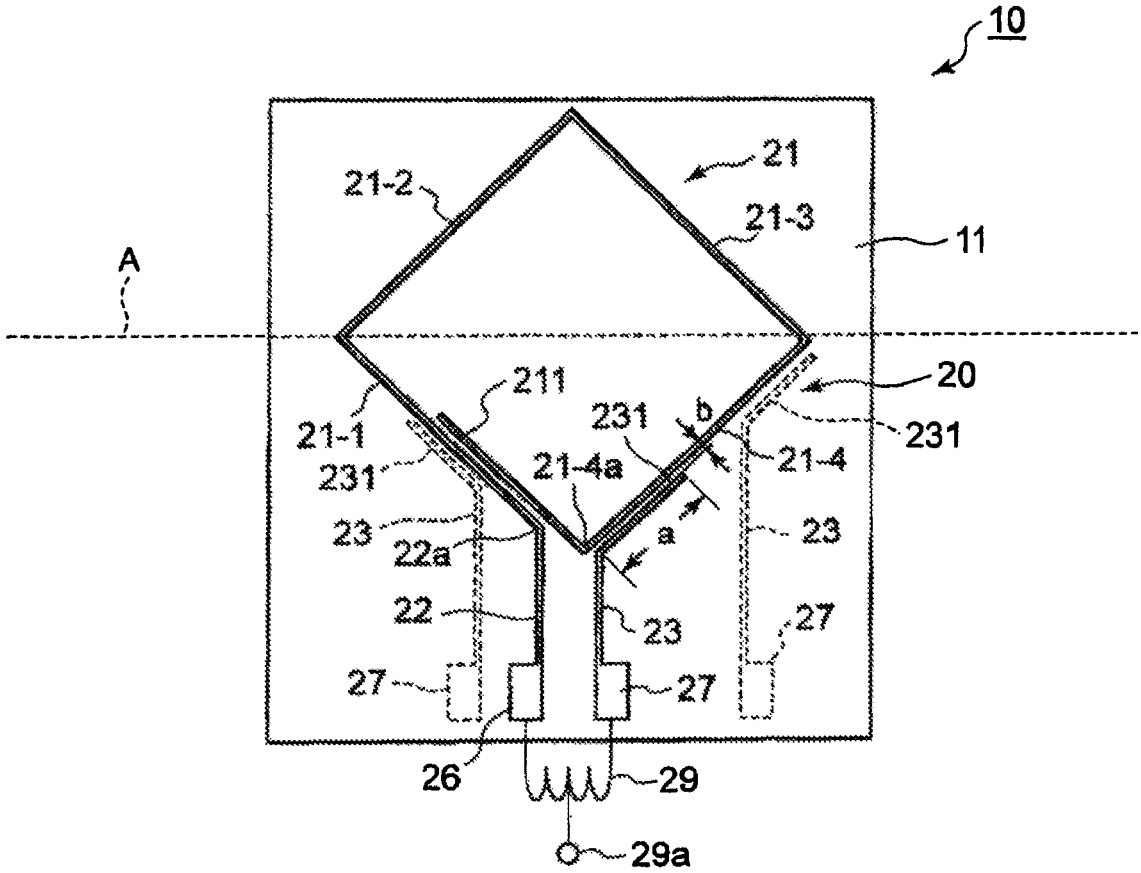
FIG. 3 is a plan view showing an antenna apparatus according to a first embodiment of the present invention.

In the above-described antenna apparatus 10 shown in FIG. 3, an impedance thereof is adjusted by the second power feeding line 23. An axial ratio thereof is adjusted by the perturbation element 211. And a reception frequency thereof is adjusted by an outer circumferential length of the radiation element 21. As a consequence, the antenna apparatus 10 can be easily designed.

Next, feeding of the electric power by utilizing the electromagnetic coupling effect achieved in the antenna apparatus 10 according to the first embodiment of the present invention will be described in more detail.

Currents are concentrated in both the first edge 21-1 and the fourth edge 21-4 of the radiation element 21, which are located in the portion lower than the dashed line "A" of FIG. 3. As a consequence, a more effect of the power feeding may be obtained if the power feeding line 23 provided for adjusting the antenna impedance is electromagnetically coupled with either the first edge 21-1 or the fourth edge 21-4.

Conversely, current distributions are small in both the second edge 21-2 and the third edge 21-3 of the radiation element 21, which are located in the portion higher than the dashed line "A" of FIG. 3. As a consequence, when the power feeding line 23 for adjusting the impedance is electromagnetically coupled to either the second edge 21-2 or the third edge 21-3, an effect of the power feeding becomes small, as compared with such a case that the second power feeding line 23 for adjusting the impedance is electromagnetically coupled to either the first edge 21-1 or the fourth edge 21-4.

As a consequence, if the first edge 21-1 and the fourth edge 21-4 of the radiation element 21 can be selected, then the impedance adjustment may be carried out at any position of these first and fourth edges 21-1 and 21-4. For instance, the second power feeding line 23 for adjusting the impedance may be set at such positions indicated by other dashed lines shown in FIG. 3.

In the antenna apparatus 10 shown in FIG. 3, an impedance adjusting operation is carried out as follows: That is, an inductance component "L" of an impedance can be adjusted by adjusting a length "a" of the above-described electromagnetic coupling portion 231 of the second power feeding line 23. Also, a capacitance component "C" of the impedance can be adjusted by adjusting a gap width "b" between the fourth edge 21-4 of the radiation element 21 and the electromagnetic coupling portion 231 of the second power feeding line 23. Thus, impedance matching of the antenna apparatus 10 can be easily adjusted in the above-described manner.

Figure 4:
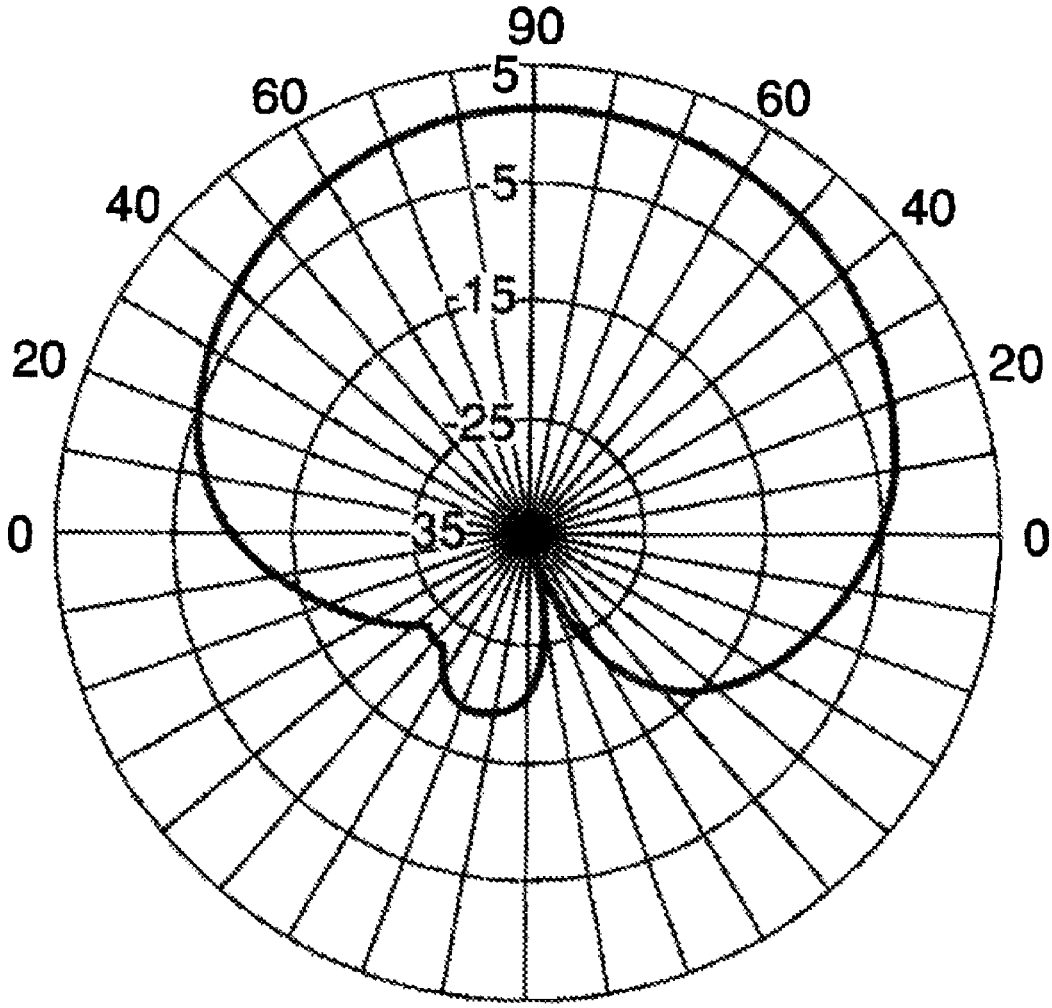
FIG. 4 is a diagram showing a radiation characteristic of the antenna apparatus shown in FIG. 3.

As can be understood from FIG. 4, a zenithal direction is a direction which the gain is high along in the antenna apparatus 10. In other words, the antenna apparatus 10 can be made very thin, and corresponds to such a directional antenna whose gain is high along the zenithal direction.

Figure 5:
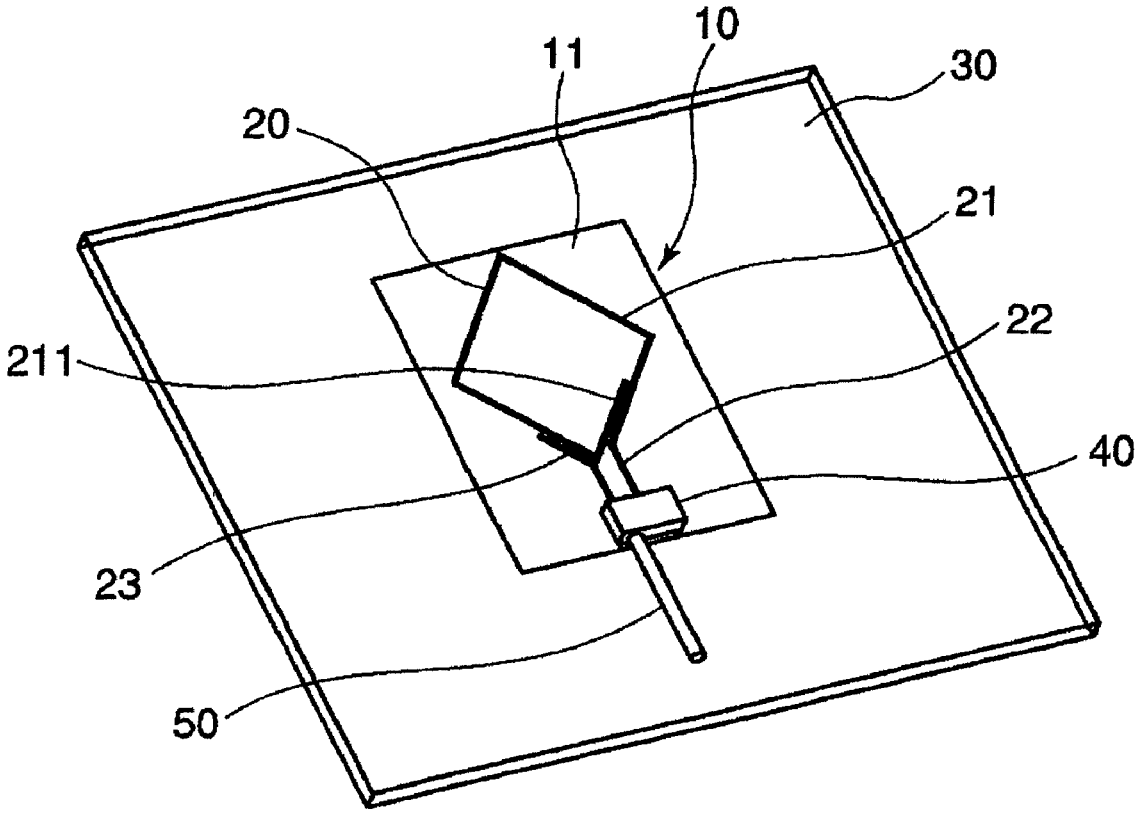
FIG. 5 is a plan view showing such a condition that the antenna apparatus shown in FIG. 3 is mounted on glass.

Referring to FIG. 5, the antenna apparatus 10 is installed on an inner side of the glass 30 such as a windshield of an automobile by utilizing a pressure sensible double-sided adhesive tape.

In this drawing, a connector (amplifier unit) 40 is connected to both the first feeding point 26 and the second feeding point 27 of the antenna apparatus 10, and a coaxial cable 50 is connected to this connector (amplifier unit) 40.

As previously described, the connector (amplifier unit) 40 contains the above-described balun 29 (refer to FIG. 3) mounted on the circuit board (not shown) arranged inside the connector 50. The connector 40 contains a low noise amplifier (LNA) circuit (not shown), and a ground pattern (not shown), which are formed on the circuit board. The intermediate terminal 29*a* (refer to FIG. 3) of the balun 29 is connected to an input terminal of this LNA circuit.

On the other hand, although not shown in the drawing, as is well known in this technical field, the coaxial cable 50 has an inner conductor located at a center, and an outer conductor having a cylindrical shape. An output terminal of the LNA circuit is connected to the inner conductor of the coaxial cable 50, and the above-described ground pattern formed on the circuit board is connected to the outer conductor of the coaxial cable 50.

In the antenna apparatus 10 shown in FIG. 5, the GPS antenna pattern 20 is formed on the resin film 11. In contrast to this antenna structure, alternatively, the GPS antenna pattern 20 may be directly embedded in the windshield 30 of the automobile. Such an alternative antenna apparatus is referred to as a glass-printed antenna.

The antenna apparatus (film antenna) 10 shown in FIG. 3 is marketed as an optional component of a vehicle dealer. As a consequence, the antenna apparatus (film antenna) 10 is not mounted in a manufacturing stage of a factory, but is commercially marketed as an appendix component provided by a vehicle dealer. In contrast to the film antenna 10, the above-explained glass-printed antenna corresponds to such a GPS-purpose antenna which is mounted by a manufacturing step in a factory, and therefore, is commercially available as an OEM component.

In the above-described glass-printed antenna, at an edge portion of the glass 30, a first signal line terminal (not shown) is connected to the first feeding point 26, and a second signal line (not shown) is connected to the second feeding point 27. A connector (not shown) which comprises the balun 29 and the LNA circuit (not shown) is mounted on these first and second signal line terminals. In other words, the connector (amplifier unit) is inserted into the first and second signal line terminals.

In the glass-printed antenna having the above-described antenna structure, since printed patterns such as an AM/FM radio and a rear defogger are formed and at the same time the GPS antenna pattern 20 is printed on the glass 30, cost (manufacturing step number) required for forming the GPS antenna is not newly produced. Also, since the connector (amplifier unit) may be merely mounted on the glass 30, the mounting shape thereof need not be changed with respect to each of vehicles. In other words, a degree at which antenna products are commonly manufactured can be improved. Furthermore, the amplifier unit is mounted on the glass 30 when the glass 30 is supplied from a glass manufacturer, so that a total number of mounting steps related to the GPS antenna can be reduced in an automobile manufacturer. Since the glass-printed antenna is employed, a good appearance of the interior portion of the vehicle can be maintained in the stylish manner, as compared with such a case that the film antenna is adhered on the glass in the post stage.

Alternatively, the amplifier unit (connector) is not installed immediately under the glass 30, but the amplifier unit may be alternatively installed at a remote place by deriving the connector from the glass 30 by connecting a lead wire (coaxial signal line) to the connector (namely, amplifier unit).

Figure 6:
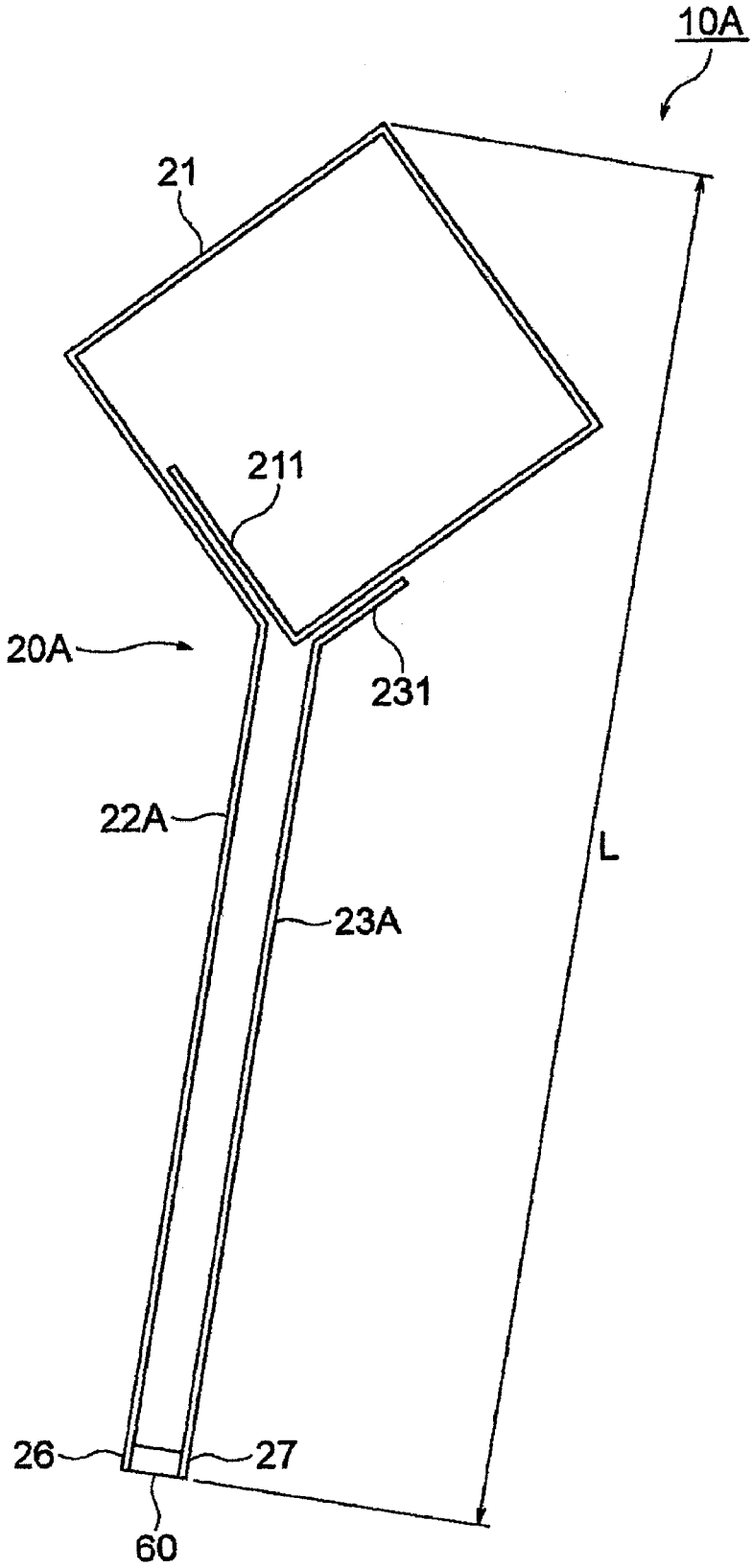
FIG. 6 is a plan view showing a composite antenna apparatus according to a second embodiment of the present invention.

Referring to FIG. 6, a description is made of a composite antenna apparatus 10A according to a second embodiment of the present invention. The composite antenna apparatus 10A shown in this drawing corresponds to such a composite antenna apparatus formed by combining a GPS-purpose antenna capable of receiving GPS signals transmitted from GPS satellites with a digital terrestrial broadcast receiving-purpose antenna for receiving digital TV signals in frequency ranges used in digital terrestrial broadcasting systems.

The composite antenna apparatus 10A shown in the drawing is constructed of a film antenna. In other words, the composite antenna apparatus 10A is constructed by employing a transparent resin film (not shown), and a composite antenna pattern 20A formed on the transparent resin film. The composite antenna pattern 20A is formed on the same plane.

The composite antenna pattern 20A is arranged by a curl-shaped radiation element (antenna element) 21 having a perturbation element 211, a first power feeding line 22A, and a second power feeding line 23A. The first power feeding line 22A is employed in order to directly feed electric power to the curl-shaped radiation element 21. While the second power feeding line 23A is elongated parallel to the first power feeding line 22A and is approximated thereto, the second power feeding line 23A is employed in order to feed electric power with respect to the radiation element 21 through electromagnetic coupling.

While the composite antenna pattern 20A shown in the drawing is different from the GPS antenna pattern 20 shown in FIG. 3, the first power feeding line 22A and the second power feeding line 23A are elongated longer than a dimension (diameter) of the radiation element 21.

In other words, in the GPS antenna pattern 20 shown in FIG. 3, a distance defined from root portions of the first and second power feeding lines 22 and 23 up to a top of the radiation element 21 is 63 mm, whereas in the composite antenna pattern 20A of FIG. 6, a distance "L" defined from root portions of the first and second power feeding lines 22A and 23A up to a top of the radiation element 21 is 120 mm. As previously described, the lengths of the first and second power feeding lines 22A and 23A are made longer in order that a total length of the composite antenna pattern 20A is made nearly equal to a ¼ wavelength of the frequency band of 600 MHz.

Since a structure of the radiation element 21 shown in FIG. 6 is identical to that of the radiation element 21 shown in FIG. 3, a detailed explanation thereof will be omitted.

A first feeding point 26 is formed at a root portion of the first power feeding line 22A, and a second feeding point 27 is formed at a root portion of the second power feeding line 23A. A balun (not shown), as shown in FIG. 3, is arranged between the first and second feeding points 26 and 27.

Figure 7:
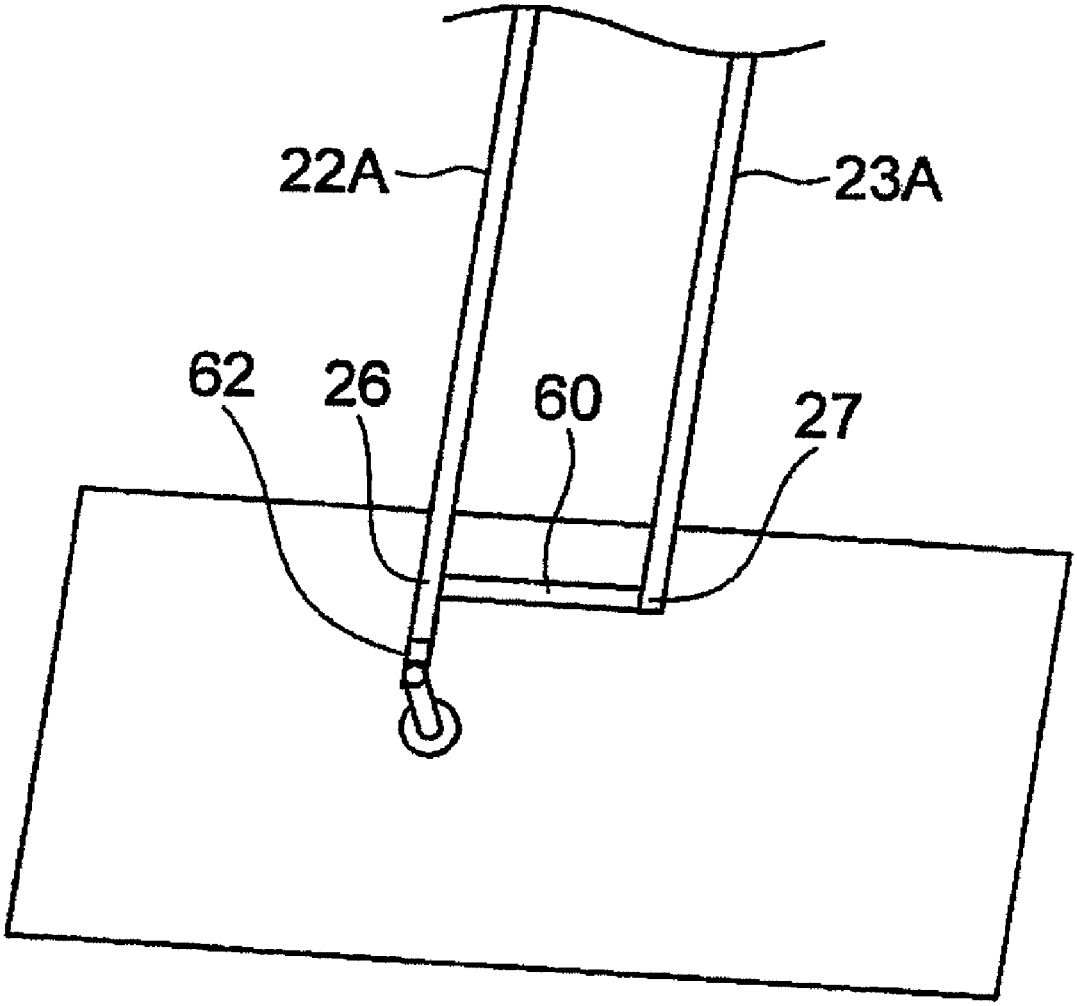
FIG. 7 is a partial enlarged view showing root portions of power feeding lines of the antenna apparatus shown in FIG. 6.

Referring to FIG. 7 in addition to FIG. 6, a parallel resonant circuit 60 having a predetermined frequency band is inserted between the first feeding point 26 and the second feeding point 27. In the example shown in these drawings, the predetermined frequency band is selected to be 1.5 GHz. As a consequence, this parallel resonant circuit 60 is designed in such a manner that the circuit between the first and second feeding points 26 and 27 are opened at the predetermined frequency band (namely, 1.5 GHz band), and the circuit between the first and second feeding points 26 and 27 is short-circuited in a frequency range other than the predetermined frequency range (1.5 GHz band).

Since the circuit between the first and second feeding points 26 and 27 is opened, a balance type antenna pattern 20A is constructed by utilizing the radiation element 21, the first power feeding line 22A, and the second power feeding line 23A, whereas since the circuit between the first and second feeding points 26 and 27 is short-circuited, the antenna pattern 20A can be operated as a monopole antenna.

In the antenna apparatus 10A shown in the drawings, the balance type antenna pattern 20A is used as such a GPS-purpose antenna for receiving GPS signals whose predetermined frequency band is selected to be approximately 1.57 GHz, whereas the monopole antenna is used as a digital terrestrial broadcast receiving-purpose antenna for receiving digital terrestrial TV broadcasting signals in the use frequency band.

It should also be understood that as shown in FIG. 7, a matching coil 62 is connected to the first feeding point 26.

Figure 8:
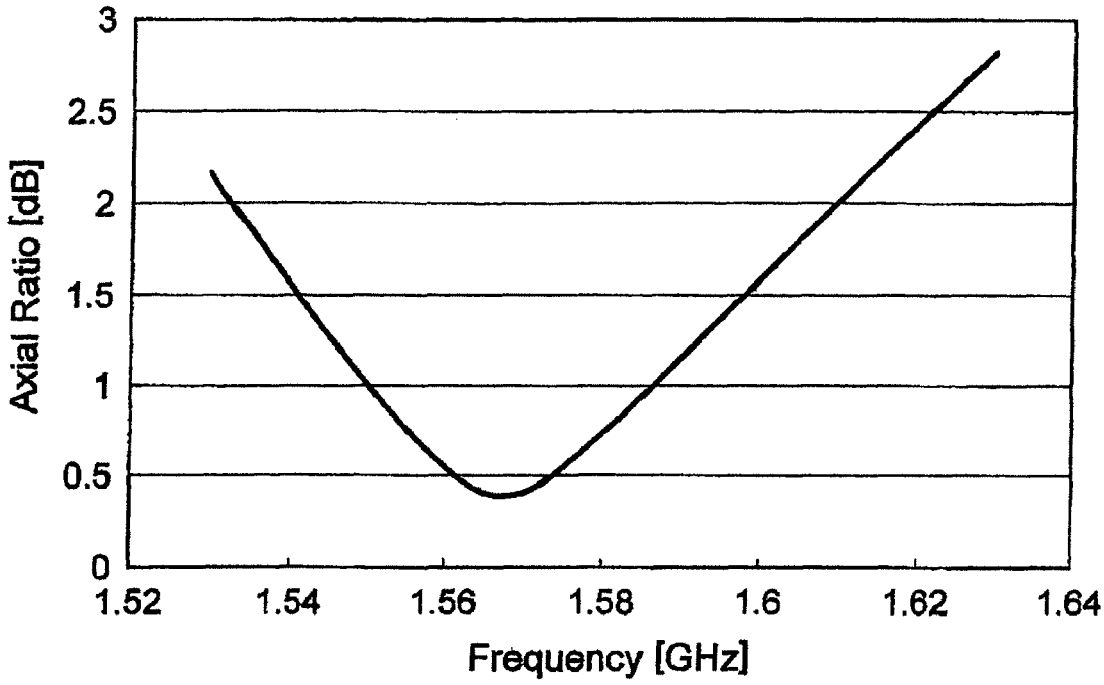
FIG. 8 is a diagram showing an axial ratio-to-frequency characteristic of the antenna apparatus shown in FIG. 6 when a circuit between first and second feeding points is opened.
Figure 9:
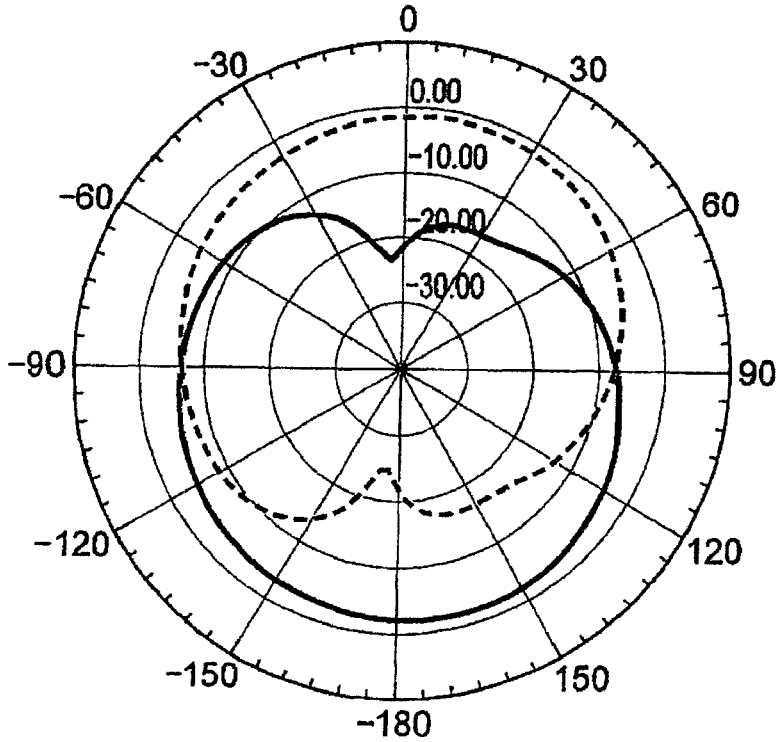
FIG. 9 is a diagram showing a directivity characteristic of the antenna apparatus shown in FIG. 6 when the circuit between the first and second feeding points is opened.

FIG. 8 and FIG. 9 show simulation results as to a radiation characteristic of the antenna apparatus 10A shown in FIG. 6 when the circuit between the first and second feeding points 26 and 27 is opened. In FIG. 8, an abscissa indicates a frequency in the unit of "GHz", and an ordinate indicates an axial ratio in the unit of "dB." In FIG. 9, a chain line indicates a gain characteristic of a right-hand circular polarized wave "RHCP", and a solid line indicates a gain characteristic of a left-hand circular polarized wave "LHCP"

As can be understood from FIG. 8, the axial ratio is small at a frequency (approximately 1.57 GHz) of a GPS signal. Also, as can be understood from FIG. 9, the gain of the right-hand circular polarized wave "RHCP" is high along the zenithal direction (namely, zero degree).

Figure 10:
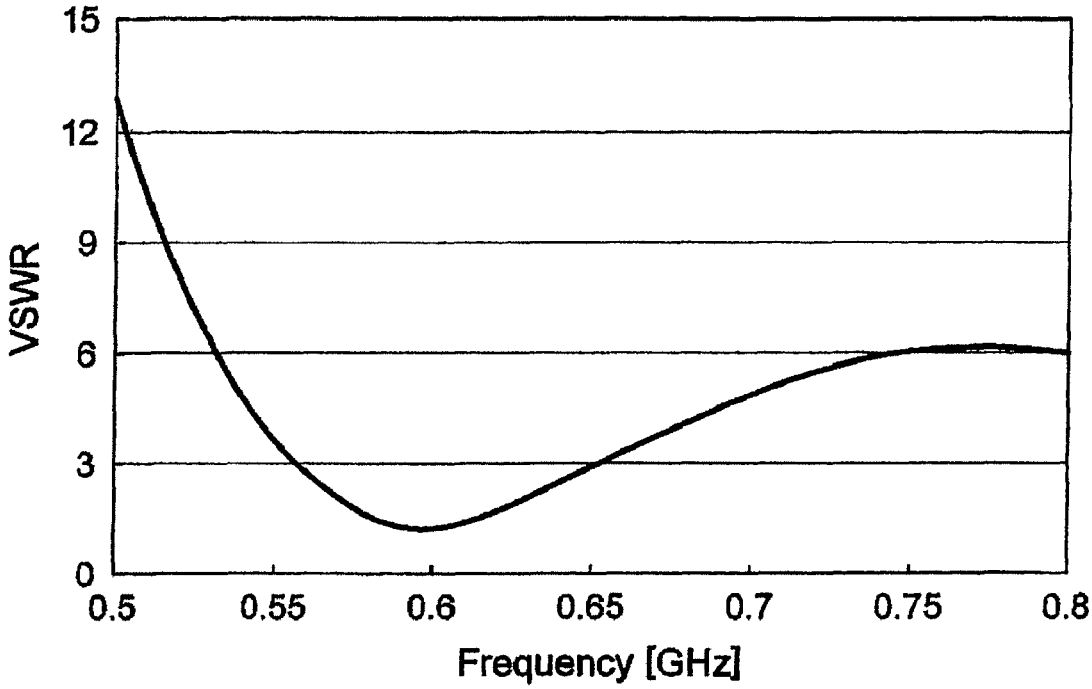
FIG. 10 is a diagram showing a voltage standing wave ratio (VSWR) characteristic of the antenna apparatus shown in FIG. 6 when the circuit between the first and second feeding points is short-circuited.
Figure 11:
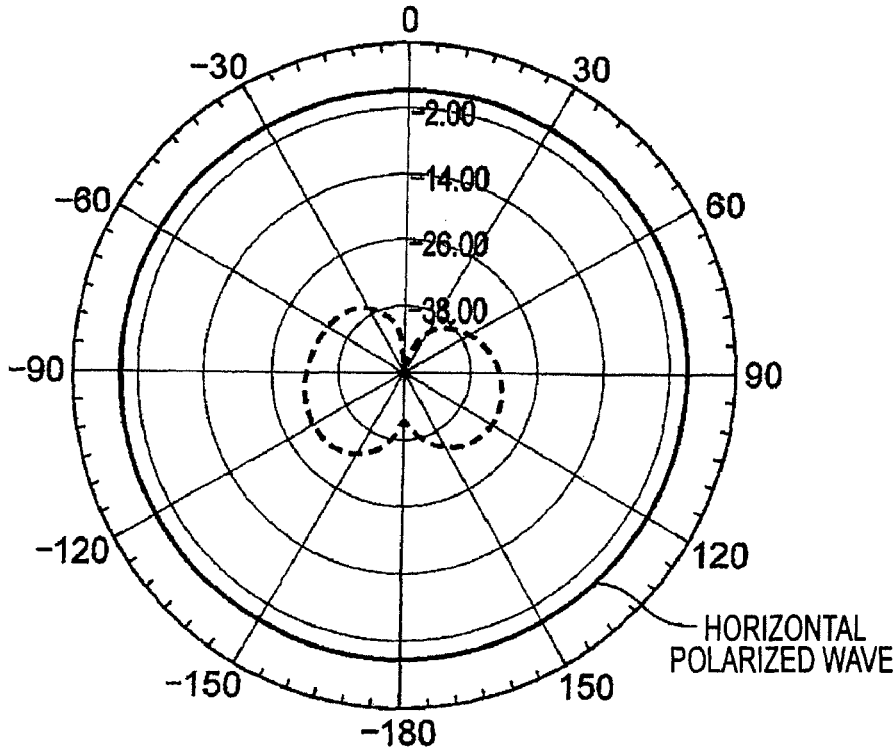
FIG. 11 is a diagram showing a directivity characteristic of the antenna apparatus shown in FIG. 6 when the circuit between the first and second feeding points is short-circuited.

FIG. 10 and FIG. 11 show simulation results as to a radiation characteristic of the antenna apparatus 10A shown in FIG. 6 when the circuit between the first and second feeding points 26 and 27 is short-circuited. That is, In FIG. 10, an abscissa indicates a frequency in the unit of "GHz", and an ordinate indicates VSWR. In FIG. 11, a chain line indicates a gain characteristic of a vertical polarized wave, and a solid line indicates a gain characteristic horizontal polarized wave.

As can be understood from FIG. 10, the VSWR is small in the frequency band (470 MHz to 770 MHz) used in the digital terrestrial broadcasting system. Also, as can be understood from FIG. 11, the gain of the horizontal polarized wave is high in the use frequency band.

As can be understood from the foregoing description, since the circuit between the first feeding point 26 and the second feeding point 27 is opened and closed, the antenna apparatus 10A can be operated as the composite antenna apparatus.

Although the preferred embodiments of the present invention is described, the present invention is not limited only to the above-described embodiments. For instance, in the above-described embodiments, as the radiation element (antenna element) 21, although such a curl-shaped antenna element having the quadrangle (rhombic) form is used, the present invention is not limited only to the antenna elements such shapes. In other words, the form of the radiation element (antenna element) 21 is not limited only to the quadrangle (rhombic), but curl-shaped antenna elements having circular, polygonal, and other forms may be alternatively used. Although in the above-described embodiments, the balun 29 is arranged between the intermediate terminal 29*a*, and both the first and second feeding points 26 and 27 so as to feed the electric power to the first and second feeding points 26 and 27. Alternatively, the electric power may be fed to the first and second feeding points 26 and 27 without employing the balun 29.

The radiation element 21 may be formed so as to have a shape other than the curled-shape. The radiation element 21, the first power feeding line 22 and the second feeding line 23 may be provided on a transparent substrate such as a glass. The radiation element 21, the first power feeding line 22 and the second feeding line 23 may be embedded in a transparent substrate which is other than a glass.

What is claimed is:

1. An antenna apparatus comprising:

a radiation element including a perturbation element;

a first power feeding line, having a first end connected to the radiation element and configured to feed power to the radiation element; and a second power feeding line, having a first end configured to feed power to the radiation element through electromagnetic coupling, wherein the radiation element, the first power feeding line and the second power feeding line are arranged on a same plane to constitute a balance type antenna.

2. The antenna apparatus set forth in claim 1, wherein:

the second power feeding line has a part extending parallel to the first power feeding line.

3. The antenna apparatus set forth in claim 1, further comprising:

a transparent substrate on which the radiation element, the first power feeding line and the second feeding line are provided.

4. The antenna apparatus set forth in claim 3, wherein:

the transparent substrate is a resin film.

5. The antenna apparatus set forth in claim 3, wherein the transparent substrate is a glass plate.

6. The antenna apparatus set forth in claim 1, further comprising:

a transparent substrate in which the radiation element, the first power feeding line and the second feeding line are embedded.

7. The antenna apparatus set forth in claim 6, wherein:

the transparent substrate is a glass plate.

8. The antenna apparatus set forth in claim 1, wherein:

the antenna apparatus is configured to serve as a GPS antenna receiving a GPS signal of a 1.57 GHz frequency band.

9. The antenna apparatus set forth in claim 1, wherein:

the second power feeding line is disposed adjacent to the first power feeding line; and the second power feeding line has a part extending parallel to the first power feeding line.

10. The antenna apparatus set forth in claim 9, further comprising:

a resonant circuit, connecting a second end of the first power feeding line and a second end of the second power feeding line in a parallel manner, so that the antenna apparatus is configured to serve as both of a balance type antenna and a monopole antenna.

11. The antenna apparatus set forth in claim 10, wherein:

the balance type antenna is configured to serve as a GPS antenna receiving a GPS signal of a 1.57 GHz frequency band; and the monopole antenna is configured to serve as a digital terrestrial antenna receiving digital terrestrial broadcasting signal.

12. The antenna apparatus set forth in claim 1, wherein:

the radiation element is curl-shaped.

13. The antenna apparatus set forth in claim 1, wherein:

the electromagnetic coupling is established at a position adjacent to the first end of the first power feeding line.

* * * * *